United States Patent [19]

Dreier et al.

[11] 4,389,952

[45] Jun. 28, 1983

BEST AVAILABLE COPY

[54] NEEDLE BAR OPERATED TRIMMER

[75] Inventors: Ernst Dreier, Steckborn, Switzerland; Richard Höss, Singen, Fed. Rep. of Germany

[73] Assignee: Fritz Gegauf Aktiengesellschaft Bernina-Machmaschinenfabrik, Steckborn, Switzerland

[21] Appl. No.: 277,388

[22] Filed: Jun. 25, 1981

[30] Foreign Application Priority Data

Jun. 30, 1980 [CH] Switzerland ..... 5007/80

[51] Int. Cl.[3] ..... D05B 65/02

[52] U.S. Cl. ..... 112/128 R

[58] Field of Search ..... 112/128, 123 R

[56] References Cited

U.S. PATENT DOCUMENTS 947,506 1/1910 Weinbach et al. ..... 112/128

2,443,369 6/1948 Alifano et al. ..... 112/128

*Primary Examiner*—Werner H. Schroeder

*Assistant Examiner*—Andrew M. Falik

*Attorney, Agent, or Firm*—Birch, Stewart, Kolasch and Birch

[57] ABSTRACT

A holder (3) for replacing the presser foot of a sewing machine comprising a foot plate (3*a*) attached to a presser bar (1) of the sewing machine (2), and a presser foot sole (8) operatively associated with the holder and being supported in a pendulating and vertically resilient fashion. A fixed blade (5) is adjustably mounted to the foot plate (3*a*) of the holder (3). A movable blade (9) is fashioned as a two-armed lever and is pivotably supported in a vertical plane. The movable blade (9) operatively engages the lower arm (13*a*) of a two-armed intermediate toggle joint with a carrier bolt (13). The other arm (13*b*) of the toggle joint has a curved cam contour (14). A control pin (15) is guided in the curved path of the cam contour (14), said pin being disposed on a control lever (16) supported (16*a*) at one end by the holder (3). The other end of the control lever is provided with a fork (6*a*) at the needle bar (6). The device, mounted as a unit by attaching the holder (3) to the presser bar (1) and by simultaneously attaching the fork (16*b*) to the cross pin (6*b*), is ready for operation without any further mounting or adjustment. During the reciprocating motion of the needle bar (6), the scissor-like knife (5, 9) cuts the edge of the length of material conveyed over the foot plate (3*a*) and underneath the pressure foot sole (8). The thus-cut edge can simultaneously be sewed to prevent raveling.

9 Claims, 6 Drawing Figures

NEEDLE BAR OPERATED TRIMMER

BACKGROUND AND SUMMARY OF THE INVENTION

The present invention relates to an attachment to a sewing machine for cutting the edges of material comprising a fixed blade and a movable blade drivable by the needle bar of the machine.

Attachments to sewing machines for cutting the edges of sewing material moving toward the sewing site, are known in various versions. Ordinarily, the blade which is driven by the needle bar and moves essentially in a vertical direction cooperates with a counter blade fixedly connected to a part of the machine. In this connection, the movable blade is either directly mounted to the needle bar or is arranged on a blade holder fastened on the working surface of the machine, as illustrated, for example, in Italian Pat. No. 603,617. The fixed counter blade is either a correspondingly constructed edge of the needle plate or a cutting edge mounted thereto.

The conventional attachments are cumbersome in handling. Mounting and adjusting operations are required with each use. Thus, it is necessary, for example to exchange the needle plate, and the blade holder must be attached on the working surface. To obtain a clean cut, an exact adjustment of the two blades with respect to each other is then necessary in each instance.

To avoid these disadvantages, the present invention has the purpose of providing an attachment of the aforementioned type which can be mounted as a unit by a few simple manipulations and requires no adjustment whatever. For this purpose, the attachment of the present invention is characterized by a holder for the fixed blade, which is detachably affixed to the presser bar of the sewing machine and is provided with a foot plate and a presser sole articulated thereto in a pendulating fashion, whereby the movable blade articulated to the holder is in driving connection with the needle bar by way of an articulated lever mechanism supported at the holder. The lever connection between the needle bar and the movable blade is advantageously such that the movable blade during the downward stroke of the needle bar is pivoted about a horizontal axis lying above the cutting edge of the fixed blade and, in the advancement direction of the length of material, behind the point of engagement of the two blade edges, this pivoting being done in the cutting sense, but only at the point when the needle bar has reached the central position corresponding to the entrace of the needle into the length of material, or has exceeded such position. In the case of sewing machines equipped for zigzag sewing, the arrangement is such that the lateral distance of the cutting plane from the center of the stitching width of the machine is at most equal to or somewhat smaller than one-half the stitch width, wherein the movable blade is recessed in the stitching zone of the needle in such a way that the needle can penetrate within or outside of the blade plane, thus making it possible to sew around the cutting edge of the length of material to prevent raveling. However, an important feature is the installation of all of its parts at a common holder, forming a unit, whereby the device can be affixed to the presser bar of the sewing machine in place of a customary presser foot and is ready for operation without previous adjusting or assembly work. Since the drive derivation from the needle bar for the movable blade is suitably effected by means of a forked lever engaging a dog at the needle mount, the fixation of the device to the presser bar and the drive connection of the device with the needle bar can be executed in the same operating step without any problems.

BRIEF DESCRIPTION OF THE DRAWINGS

The present invention will become more fully understood from the detailed description given hereinbewlow and the accompanying drawings which are given by way of illustration only, and thus are not limitative of the present invention, and wherein.

DETAILED DESCRIPTION OF THE INVENTION

Figure 4:
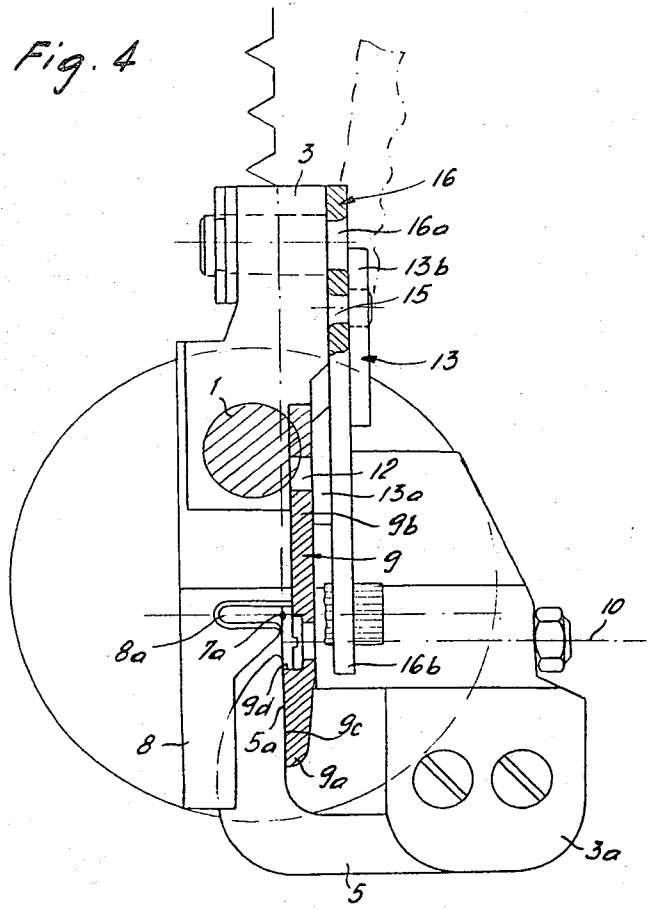
FIG. 4 shows a top view of FIG. 1, partially in section.
Figure 6:
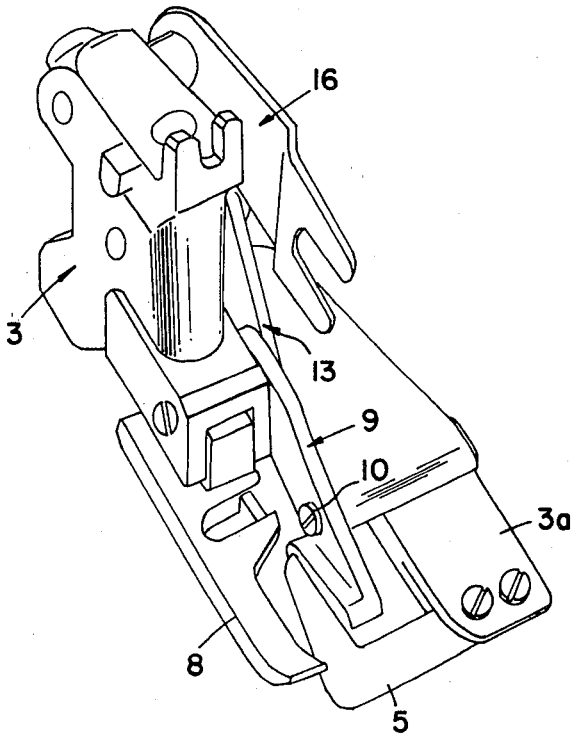
FIG. 6 is a perspective view of the pressure foot of the present invention.

A holder 3 provided with a foot plate 3*a* is detachably mounted to the presser bar 1 of a sewing machine 2, equipped with a means for zigzag stitching. Mounting is accomplished with the aid of a clamping means 1*a* (serving for the attachment of a customary presser foot). By means of screws 4, a blade 5, oriented with its working edge in parallel to the advancing direction of the machine, is attached to the foot plate 3*a* extending laterally with respect to the presser bar 1 toward the operator's side and forwardly toward the material feeding side of the machine. The tip of the blade terminates directly in front of the stitching zone of the needle 7 attached to the needle bar 6. The arrangement is such that the blade edge 5*a* (FIG. 4) is in alignment with the needle penetration point 7*a* on the operator's side at the largest (or also slightly smaller) needle displacement toward the operator's side of the machine. Furthermore, as can be readily seen in FIG. 6, a presser foot sole 8 with a stitching slot 8*a* is supported at the holder 3 to be pendulating in a vertical plane and is axially movable to a limited extent under a spring load. The presser foot sole is disposed in the usual way above the feed of the sewing machine. Furthermore, a movable blade 9 fashioned as a double lever 9*a*, 9*b* bent at an obtuse angle is arranged to be pivotable in a vertical plane at the support foot plate 3*a* of the holder 3. The cutting edge 9*c* of the blade 9, arranged with its axis 10 in the zone of the tip of the fixed blade 5 but above the cutting edge 5*a*, is provided at the forwardly projecting lever arm 9*a*. As can be seen from FIG. 4, the movable blade 9 is offset behind the cutting edge 9*c*, i.e. in the region of the bearing point and at the arm 9*b*, as shown at 9*d*, in such a way that a lateral displacement of the needle 7 is also possible, somewhat beyond the line of alignment of the cutting edges 5*a*, 9*c*. The arm 9*b* of the blade 9 is provided with a receiving slot 11 for the carrier bolt 12 on the one arm 13*a* of a two-armed intermediate toggle joint 13. The intermediate toggle joint 13, pivotably mounted about a horizontal axle journal 13*c* at the holder 3 and being slightly bent toward the operator's side of the machine, is equipped at its other arm 13*b* with a control cam contour 14 wherein a control pin 15 is guided. The control pin 15 is disposed on a control lever 16, which is pivotably mounted at the holder 3 on one end by means of a bearing pin 16*a* which is parallel to the bearing pins 10 and 13*c* and which is provided with a fork 16*b* on its other end. The fork 16*b*, engaging with a cross pin 6*b* of the needle mount 6*a*, couples the movable blade 9 via the intermediate toggle joint 13 with the needle bar 6. It is to be noted that the control cam contour 14 of the intermediate toggle joint 13 extending approximately in the longitudinal direction of the lever arm 13*b* exhibits a circular-arc-shaped branch 14*a* toward the lever end. The central radius of this arc corresponds to the axial distance of the control pin 15 from the bearing pin 16*a*, with the branch 14*a* passing over toward the bearing pin 13*c* into a linear branch 14*b*.

Figure 2:
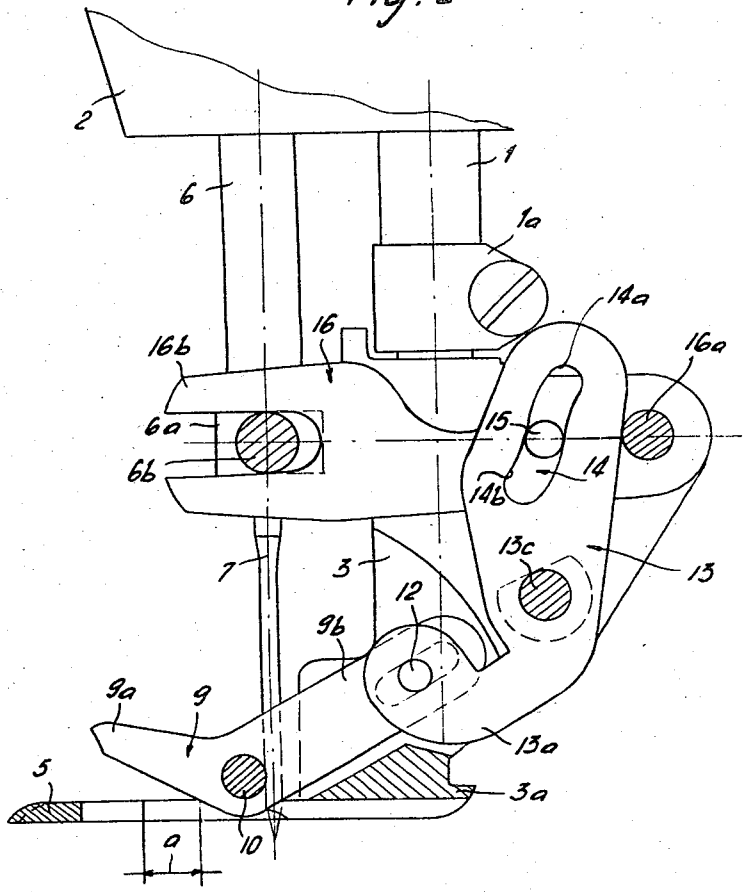
FIGS. 1, 2 and 3 show, respectively, a lateral view of the device, partially in section, in various needle positions.
Figure 1:
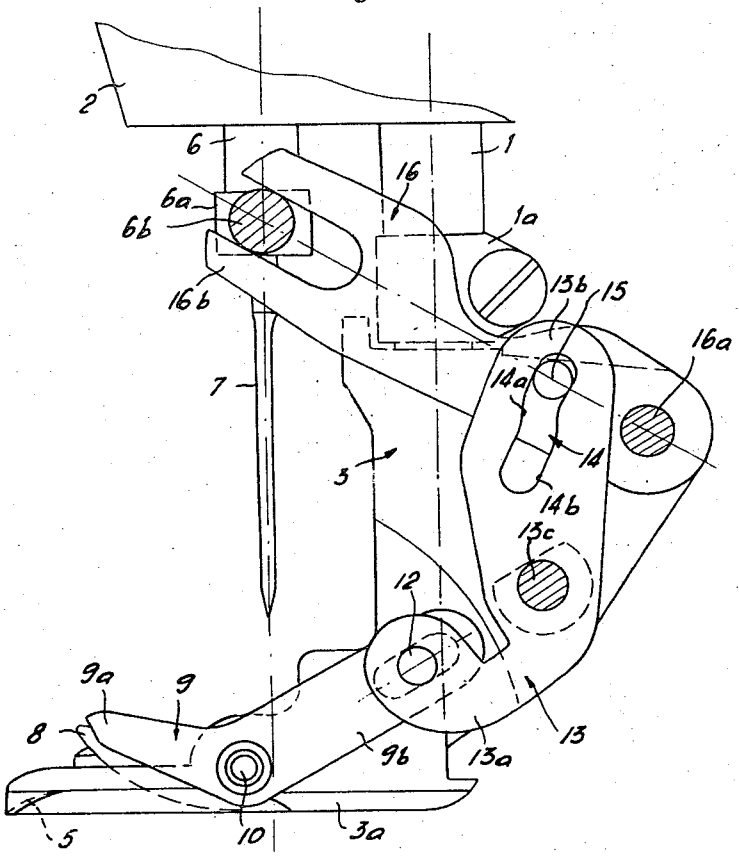
Figure 3:
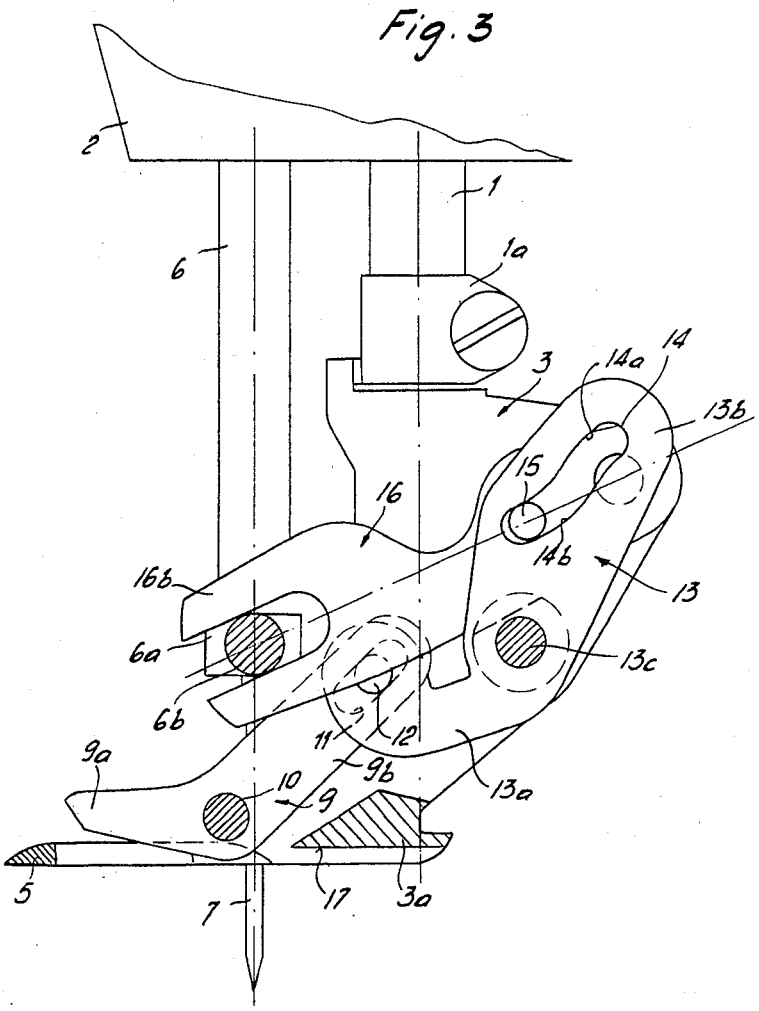
Figure 5:
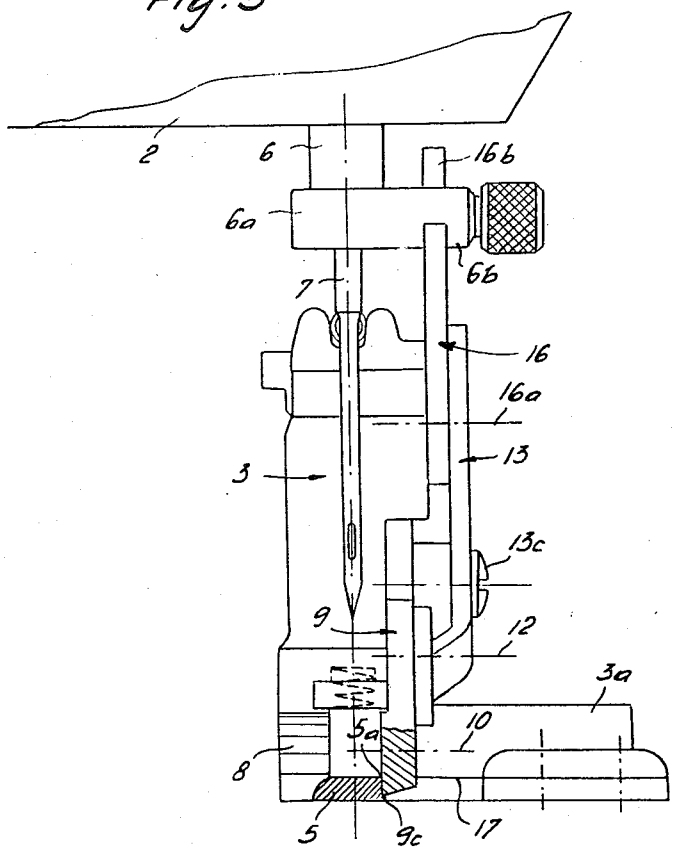
FIG. 5 shows a frontal view of FIG. 1, likewise partially in section

The mode of operation of the aforedescribed edge cutting device is as follows: First of all, the normal presser foot of the machine is taken off and, by means of the same mounting mechanism, the holder 3 of the cutting device is attached to a raised presser bar 1 by attaching the fork 16*b* to the cross pin 6*b* of the needle mount 6*a* when the needle bar 6 is in its upper end position. During the lowering of the presser bar 1, the foot plate 3*a* with the fixed blade 5, as well as the resilient presser foot sole 8 come into contact with the operating surface of the sewing machine. The movable blade 9 is held, with its maximum opening of the angle of articulation between the control lever 16 and the blade arm 9*b*, by means of the control lever 16 and the intermediate toggle joint 13 in its inactive position, i.e., according to FIG. 1 in a position maximally pivoted in the clockwise direction. In this connection, it can be seen that the control pin 15 is located in the upper end portion of the circular-arc-shaped cam contour branch 14*a* of the intermediate toggle joint 13. The device is thus immediately ready for operation without any additional assembly, alignment, or adjustment being necessary. The length of material to be worked on is, at this point, conveyed over the foot plate 3*a*, having the form of a ramp on the front side, underneath the presser foot sole 8, and, with the sewing machine in operation, by the feeder means between the scissor-like gaping blade edges 5*a* and 9*c*. During the downward stroke of the needle bar 6, from a position as shown in FIG. 1 to a position as shown in FIG. 2, the control lever 16 is initially pivoted in the counterclockwise direction without affecting the intermediate toggle joint 13. During this step, the control pin 15 moves downwardly along the circular-arc-shaped cam contour branch 14*a*. At the same time, the needle 7 stitches into the length of material. During the further downward motion of the needle bar 6, the control pin 15 enters the linear branch 14*b* of the cam contour 14, effecting a pivoting of the intermediate toggle lever 13 in the clockwise direction. The toggle lever, by way of the carrier bolt 12, in turn pivots the movable blade 9 in the counterclockwise direction. As a result, the edge of the length of material is cut, while simultaneously executing a sewing step in correspondence with the set stitch in the zone denoted by a in FIG. 2. During the subsequent upward movement of the needle bar 6, the scissor-like knife 5, 9 opens up again, and the above-described cycle is repeated. it is to be kept in mind that the cut-off edge of the length of material is removed in an appropriate bottom recess 17 in the foot plate 3*a*. In case the cut-off portion has an abnormal width, this portion can also be removed by transporting it over the foot plate 3*a*.

It can be seen from the above description that, simultaneously with cutting the edge of the length of material, the latter can also be sewed around the edge to prevent raveling, or can be provided with any desired seam depending on the set stitch pattern and position. However, it is also possible to cut a length of material without the simultaneous formation of a seam, by removing the needle 7 or, in the case of a straight stitch setting, by pivoting the needle to such an extent that its stitching site is outside of the plane of the cutting edge (on the operator's side). Although the attachment normally serves for the cutting off or cutting to size of fabrics, other materials, such as, for example, paper or leather, can likewise be worked on correspondingly. Thanks to the vertically resilient mounting of the presser foot sole 8, even relatively thick materials do not cause an upward urging of the presser bar 1, as is the case in conventional presser bars. Due to the mounting of the presser foot sole 8, which is vertically resilient with respect to the foot plate 3*a* which always rests on the working surface of the sewing machine, the cutting function of the device remains independent of the respective thickness of the material.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An attachment for use with a sewing machine for cutting the edges of material, said sewing machine containing a needle bar and a presser bar, which comprises, a fixed blade containing a cutting edge and a movable blade, said movable blade being driven by said needle bar of the sewing machine, a holding means for mounting the fixed blade thereto, said holding means being, in turn, detachably mounted at one end to said presser bar of the sewing machine and provided at the other end thereof with a foot plate, a presser foot sole operatively connected to said foot plate in a pendulating fashion and said movable blade being pivotable connected to said holding means, and an intermediate articulated lever system supported by said holding means, said intermediate articulated lever system providing driving connection between the needle bar and the movable blade wherein said movable blade is a double-armed lever, one arm being provided with a cutting edge which cooperate with the cutting edge of the fixed blade to provide a scissor-like action and the other arm thereof being pivotally connected by slot means to said needle bar through said intermediate articulated lever system.

2. The attachment of claim 1 wherein the intermediate articulated lever system comprises an intermediate toggle joint and a control lever, one end of said intermediate toggle joint containing a carrier both for engagement with the slot in the double armed lever of the movable blade, the other end of said intermediate toggle joint being provided with a control cam contour, and one end of said control lever being provided with a slot for sliding engagement with the needle bar whereas the other end of the control lever contains a control pin, said control pin being in sliding engagement with said control cam contour.

3. The attachment of claim 2 wherein the needle bar contains a needle mount provided with a cross pin, said cross pin being in sliding engagement with the slot of said control lever.

4. The attachment of claim 2 wherein the control lever contains a bearing axle disposed adjacent said control pin, and the control cam contour of the intermediate toggle lever possesses at its upper end a circular-arc-shaped curved branch, the radius of which is equal to the axial distance of the control pin from the bearing axle of the control lever, and possesses at its lower end a linear curve branch, whereby during the first phase of the downward movement of the needle bar leading to the penetration of the material by the needle, the scissor-like unit formed by the fixed and movable blades remains open and the cutting step takes place only during the lower movement phase of the needle bar.

5. The attachment of claim 4 wherein the cutting edges of the fixed and movable blades lie in a vertical plane extending through or substantially through the outermost stitch entrance point of the needle, on the operator's side.

6. The attachment according to claim 5 wherein the bearing axle of the movable blade lies in front of the stitch-in point of the needle and above the blade edge of the fixed blade.

7. The attachment according to any one of claims 1 or 2 to 6 wherein the fixed blade is adjustably mounted to the foot plate of the holding means.

8. The attachment according to claim 7 wherein the foot plate and the fixed blade possess a ramp-like configuration at their front faces so that the material to be cut can run onto these elements, and the foot plate contains a lower recess permitting the removal of the cut-off material.

9. The attachment according to claim 8 wherein the foot sole is articulated to the holding means in a vertically resilient fashion.

* * * * *

UNITED STATES PATENT AND TRADEMARK OFFICE

CERTIFICATE OF CORRECTION

PATENT NO. : 4,389,952

DATED : June 28, 1983

INVENTOR(S) : Ernst Dreier et al

It is certified that error appears in the above-identified patent and that said Letters Patent are hereby corrected as shown below:

Item No. 73: Please change "Fritz Gegauf Aktiengesellschaft Bernina-Machmaschinenfabrik" to --Fritz Gegauf Aktiengesellschaft Bernina-Naehmaschinenfabrik--

Signed and Sealed this

*Eighth* Day of *November 1983*

[SEAL]

*Attest:*

GERALD J. MOSSINGHOFF

*Attesting Officer*

*Commissioner of Patents and Trademarks*